United States Patent [19]

Tompkins et al.

[11] 4,437,660

[45] Mar. 20, 1984

[54] WORD PROCESSOR—CONTROLLED PRINTER OUTPUT SCANNER MECHANISM

[75] Inventors: Elliot N. Tompkins; Sherman S. Kline, both of San Antonio, Tex.

[73] Assignee: Datapoint Corporation, San Antonio, Tex.

[21] Appl. No.: 321,808

[22] Filed: Nov. 16, 1981

[51] Int. Cl.[3] ..... B65H 43/08

[52] U.S. Cl. ..... 271/290; 271/176; 271/298; 250/561; 209/534; 194/1 B; 414/274

[58] Field of Search ..... 271/288, 289, 290, 298, 271/176; 250/560, 561; 194/1 A, 1 B; 209/534; 414/274

[56] References Cited

U.S. PATENT DOCUMENTS

| | | | |
|---|---|---|---|
| 3,681,607 | 8/1972 | Hartman | 250/223 R |
| 3,871,643 | 3/1975 | Kukucka | 271/290 |
| 4,330,200 | 5/1982 | Kikuchi | 271/288 X |
| 4,331,879 | 5/1982 | Gersl | 250/561 |
| 4,361,320 | 11/1982 | Kikuchi | 271/288 |

*Primary Examiner*—Richard A. Schacher

*Attorney, Agent, or Firm*—McCamish, Ingram, Martin & Brown

[57] ABSTRACT

A scanning mechanism is provided for scanning individual output bins for receiving documents from a paper printer. The mechanism determines each bin's availability for receiving documents, the degree of fullness and whether or not a lock box is positioned in the bin for receiving designated documents.

10 Claims, 6 Drawing Figures

WORD PROCESSOR—CONTROLLED PRINTER OUTPUT SCANNER MECHANISM

INCORPORATION BY REFERENCE

Applicant(s) hereby incorporate(s) by reference the structural details and descriptions included in the following patent applications, each of which is assigned to the assignee of the present invention.

(1) U.S. Patent Applications

"Connecting Mechanism For Word Processor-Controlled Printer Output Module Cabinets", Ser. No. 321,807, filed on Nov. 16, 1981, in the names of Franklyn H. Witten and Sherman S. Kline; and "Word Processor-Controlled Printer Paper Transport", Ser. No. 322,095, filed on Nov. 16, 1981, in the name of Sherman S. Kline.

(2) Patent Cooperation Treaty Application

"Word Processor-Controlled Output Printer Bin Lock Box", Ser. No. 347,134, filed on Nov. 16, 1981, in the International Receiving Office in the names of David R. Davis, Shermal S. Kline, Victor D. Poor and Elliot N. Tompkins.

BACKGROUND OF THE INVENTION

This invention relates generally to a word processor output bin for use with a word processor-controlled printer or the like. In particular, it relates to a scanning apparatus to determine the content of a plurality of output bins which receive paper from a printing machine.

The use of high speed word processing equipment is becoming commonplace in businesses. The system generally includes a word processing station for an operator to key in information into a word processor which records the information on a recording medium such as magnetic disc, tape or other memory. The memory directs the coded information to a printer or image reproducer which may be an electrophotographic printing mechanism, such as a laser printer. The printer is coupled to a paper supply source, and a paper handling mechanism directs paper from the paper supply source through a printer which can have the ability to print data, text and graphic information on a paper. The paper handling mechanism then directs the finished products to a paper receiving station or output bin.

When a plurality of output bins are provided, it is necessary to provide information to the paper handling mechanism and printer in order to direct the output from the printer to a proper output bin which is capable of receiving and collecting the printed documents.

The invention is directed to a scanning mechanism which scans a plurality of output bins to determine the availability of the bins for receiving documents and the number of documents which are present in a bin. In order to instruct the computer as to the content of each output bin, it is necessary to detect or monitor whether or not any documents are in a bin, the number of documents in the bin, as well as a particular bin to which documents are to be directed by a printer. The present invention provides a scanning mechanism which can detect a small number of sheets of paper in a bin, as well as the quantity of documents in a bin. When a lockbox is inserted in one of these bins to provide security to the documents put in the lockbox, the scanner detects which bin contains a lockbox and signals which lockbox to which the documents should be directed.

Other objects of the invention will be apparent from the detailed description of the invention.

BRIEF SUMMARY OF THE INVENTION

The invention comprises a work processor output module containing output bins for receiving documents from a paper printer. A scanning mechanism is provided to scan each output bin and determine its availability for receiving documents, the number of documents already in the bin and whether or not a lockbox is positioned in the bin for receiving designated documents. The scanning mechanism includes a signal means which may include an LED and a detecting mechanism which may be photo detector. The scanning apparatus is mounted on a vertical guideway or track and has a traveling carriage mounted for movement up and down on the track which is positioned adjacent a plurality of output bins. Each output bin has a plurality of apertures for allowing passage of the signal so that it may be detected to assist in determining the amount of documents in the output bin. The travel carriage may also include an additional detecting mechanism to determine when a lockbox is positioned in the output bin and to determine which lockbox is to receive the documents from a printer.

DETAILED DESCRIPTION OF THE INVENTION

Figure 1:
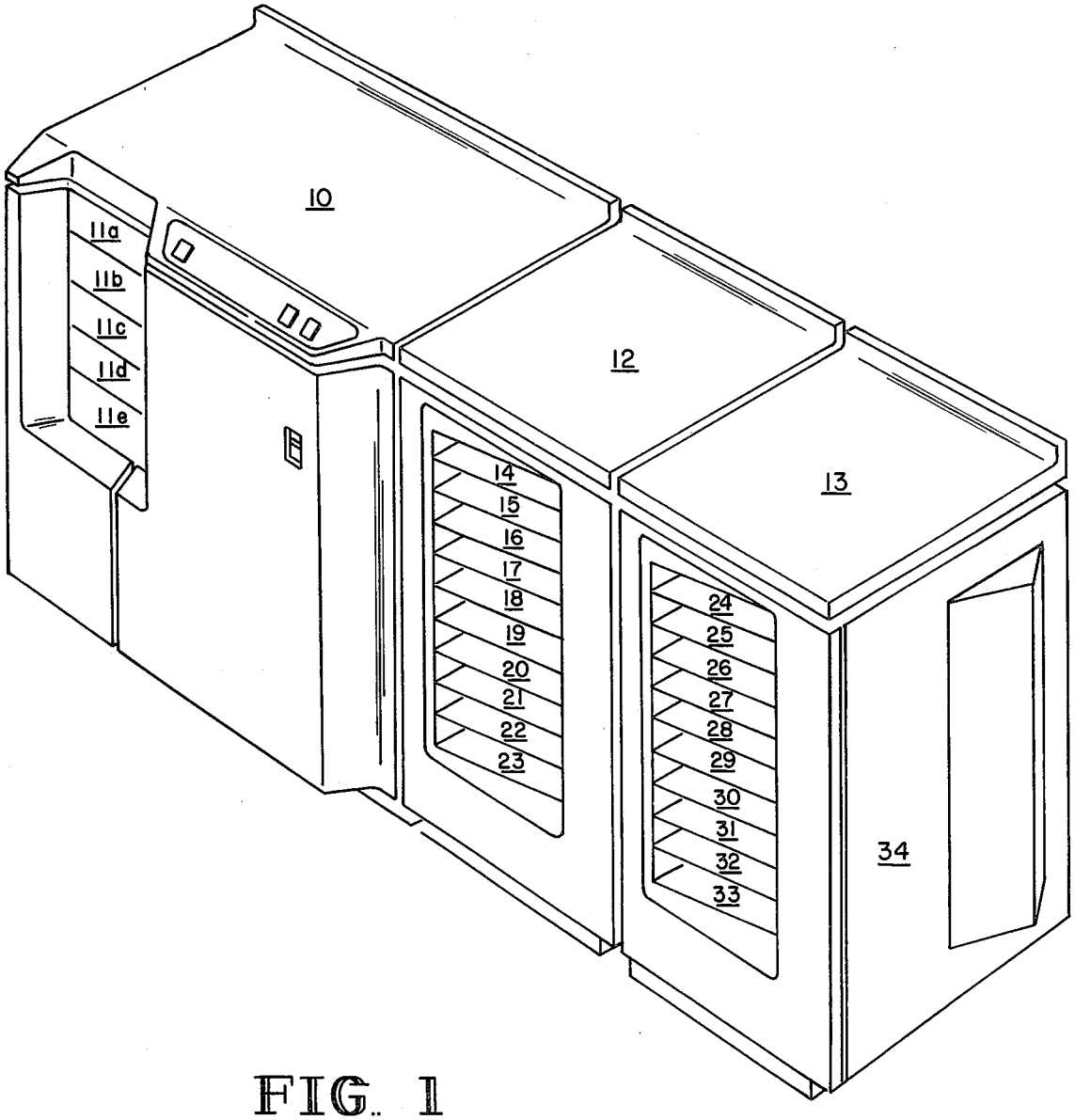
FIG. 1 is a view of printing apparatus having a plurality of output bin modules connected to a printing apparatus for receipt of printed documents.

Referring to FIG. 1 of the drawing, there is shown a printer mechanism 10 which includes a plurality of paper supply bins 11*a*, 11*b*, 11*c*, 11*d*, 11*e* which selectively supply a predetermined type and size of paper to printing mechanism (not shown) of conventional construction positioned within the cabinet of the printer mechanism 10. Removably connected with the printer mechanism 10 are a plurality of output bin modules 12 and 13 which are removably connected with the printer mechanism for receiving paper which has been processed with printing.

Each module includes a plurality of output bins 14, 15, 16, 17, 18, 19, 20, 21, 22, 23, 24, 25, 26, 27, 28, 29, 30, 31, 32, and 33. Although only two output bin modules are shown, it is understood that the cabinet wall 34 can be removed to add as many as six additional output bin modules.

A paper feeding mechanism (not shown) supplies printed documents to a selected one of the output bins 14–33 in response to a computer apparatus which controls a feeder mechanism which selectively directs each sheet of paper from the printer mechanism 10 to a predetermined output bin.

Figure 6:
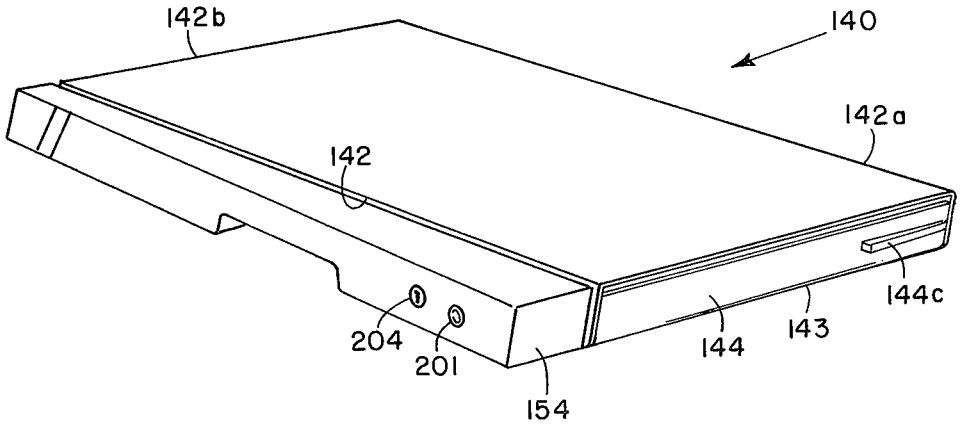
FIG. 6 shows a lockbox for insertion in an output bin.

The printing apparatus within the printer mechanism 10 may be of the laser printer type or other electrophotographic engine. The paper supply bins 11*a*, 11*b*, 11*c*, 11*d* and 11*e* are controlled by the computer apparatus to determine which type and size of paper are supplied to the printer contained within the printer mechanism 10. The printer mechanism 10 may be of the type which prints on one side or both sides of the paper. In normal operation the paper which is processed through the printer of the printer mechanism 10, would be directed by a paper feeding means to a predetermined one of the output bins 14–33 by the paper transporting mechanism. An operator would then remove the printed material from the selected bin. Referring to FIG. 6 of the drawing, there is shown a lockbox 140 which is inserted in and received by any one of the output bins 14–33. One or more lockboxes could be inserted in the output bins when it is desired to retain the documents fed into the selected lockbox in confidence.

Each lockbox is basically a closed generally rectangular box and is inserted into a selected one of the output bins. The lockbox 140 has a set of locks 201 and 204 in its face member 154. The lock 204 is available only to the user of source of the documents which are fed into the lockbox and who is the ultimate receiver of the document. A master key for the lock 204 allows access to the documents. When the box is emptied by the person having a key to lock 204, it can be preset to a paper receiving position and carried to the machine by messenger or other personnel and inserted in the appropriate bin location in the machine. Each lockbox includes a door 144 at one end which can be positioned to receive documents when it is partially opened, retain documents in confidence when it is fully closed, or move to a fully opened position for removal of documents from the box. When inserted in the output bin, the door on the lockbox is in a paper receiving position with the door partially opened. Catch member 144*c* engages a mating notch or opening in the walls of the output bin to retain the lockbox in its locked position. A lockbox can only be removed by someone who has a key to lock 201 which will fully close the door and disengage the catch 144*c* from the output bin to allow removal of the box. The second key mechanism for lock 201 can only be used to close the paper receiving door which allows removal of the lockbox from the output bin. The lockbox cannot be removed from the output bin without positioning the paper receiving door to its locked position.

Each lockbox includes top portion 141, side portions 142 and 142*a*, end portion 142*b* and a bottom portion 143. The door 144 is pivotally connected to the sides 142 and 142*a* for selectively allowing feeding of paper into the box when positioned in the output bins, for locking the box to prevent removal of the documents from the box and to open the box to allow removal of documents from the box.

Figure 2:
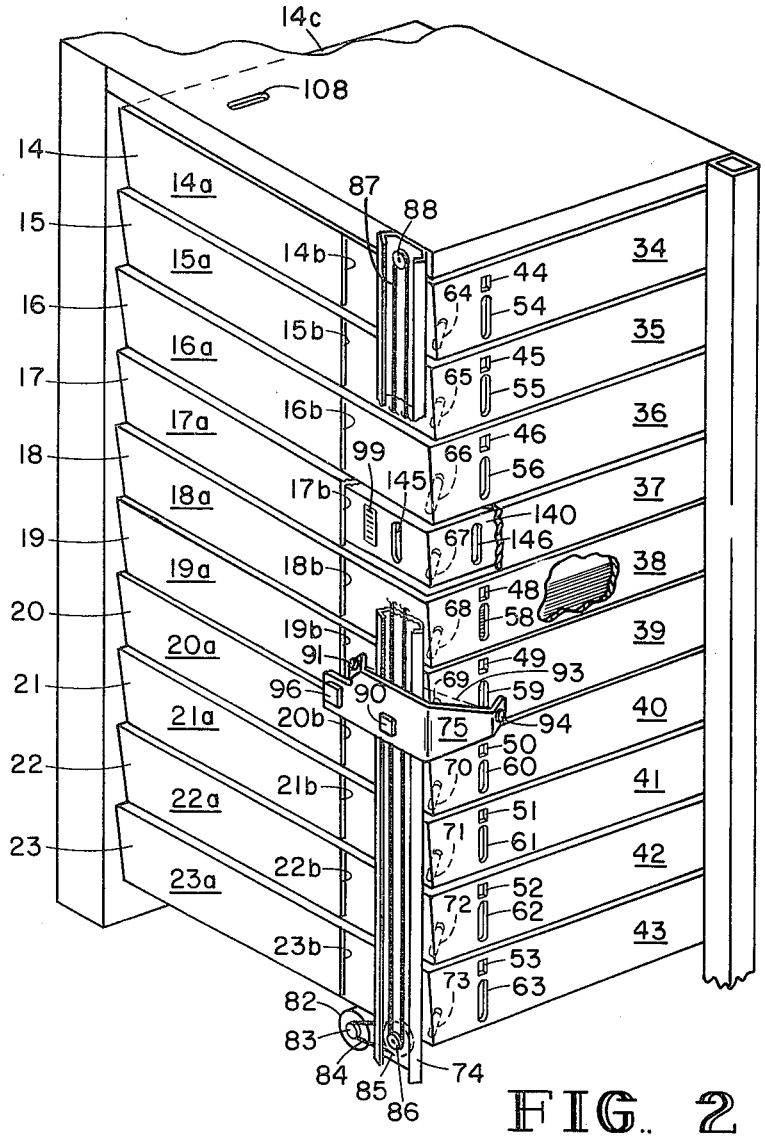
FIG. 2 is a partial broken view showing the output bins of the module and a scanning mechanism for scanning each output bin.

Referring to FIG. 2 of the drawing, there is shown a partial view from the rear of modules 12 and 13 with the housing removed to expose the scanning mechanism. The back of the output box 14 includes a wall member 14*a* terminating in an edge 14*b*. Each of the output bins 15–53 includes similar wall members 15*a*, 16*a*, 17*a*, 18*a*, 19*a*, 20*a*, 21*a* 22*a* and 23*a*, respectively, which terminate in edges 15*b*, 16*b*, 17*b*, 18*b*, 19*b*, 20*b*, 21*b* and 23*b* respectively. Each output bin is identical in construction and size for receiving the lockbox 40 which closely fits within the output bin. The output bins 14–23 include additional side walls 34, 35, 36, 37, 38, 39, 40, 41, 42, and 43. It is understood that each output bin includes another wall which is shown in broken lines as wall 14*c* for output bin 140 which includes a notch or reset portion 108 for lockably receiving the catch member 44*c* when the lockbox is inserted in an output bin. Although not shown, it is understood that each bin includes a wall corresponding to the wall 14*c* with a similar notch 108 for receiving a lockbox.

Each of the wall members 34–42 includes a small slot 44, 45, 46, 48, 49, 50, 51, 52 and 53 respectively as more fully explained hereinafter. Each of the wall members 34–43 also respectively include an additional longer slot or cutout 54, 55, 56, 58, 59, 60, 61, 62, 63 also for a purpose more fully explained hereinafter.

The bottom wall or surface of each output bin 14–23 includes a slot 64, 65, 66, 67, 68, 69, 70, 71, 72 and 73 respectively which are used in conjunction with slots 44–53 in connection with the scanning means.

Figure 3:
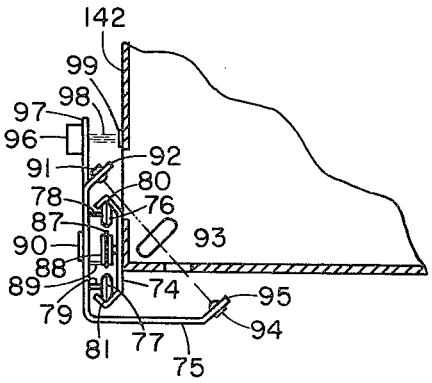
FIG. 3 is a partial cross sectional view showing the scanning mechanism and the output bin structure.

The scanning means includes a vertical track member 74 having a generally C-shaped cross section as best shown in FIG. 3. A carriage 75 is operatively connected to the track 74 by rollers 76 and 77 rotatably mounted upon axles 78 and 79. The outer edges of the rollers engage the V-shaped portions 80 and 81 of the tracks 74 so that the carriage 75 is vertically movable relative to the track 74 to scan the bins 14–23.

A reversible motor 82 is connected with the track 74 and includes a drive pulley 83 upon which is mounted a belt 84 which rotates another pulley 85 secured to pulley 86 which pulleys 85 and 86 are rotatably secured to the tract 74. A belt means 87 is rotatably mounted on the pulley 86 and extends along the inner portion of the track to its upper end where it is mounted upon a pulley 88 also rotatably mounted to the track 74. An arm 89 is secured to the carriage 75 and to one side of the belt 87 such that the carriage will be caused to move vertically along the track 74 upon movement of the belt 87 by the motor 82. A travel limit sensor 90 is secured to the carriage 75 to control its movement between the bins 14 and 23. A detector detects the movement of the limit sensor 90 between its uppermost position where the carriage 75 is positioned to scan the bin 14 to its lowermost position where the carriage 85 is positioned to scan the bin 23. The motor 82 is controlled to provide this up and down movement of the carriage 75 to scan the bins 14–23. A suitable control means, which is controlled by the computer of the printer mechanism 10 signals the motor 82 to actuate and provide the scanning function.

An LED or similar light source 91 is mounted on tab member 92 to provide a signal beam shown schematically as 93. A photo detector 94 is mounted upon tab member 95 to detect the light beam 93.

Figure 5:
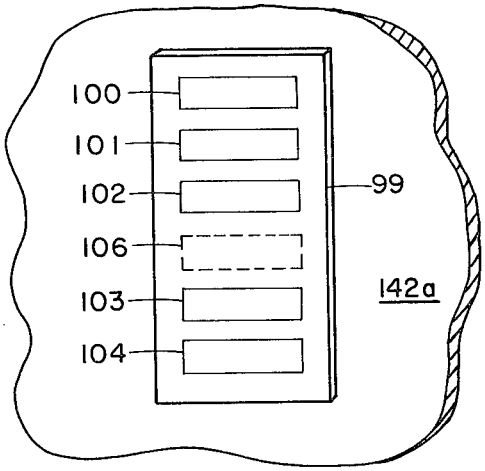
FIG. 5 is a partial view showing the coding means for each lockbox.

A retroreflective or transmissive assembly 96 is secured on the tab member 97. The retroreflective assembly 96 sends a light signal such as infrared light shown schematically at 98 which impinges on a reflective strip 99 (See FIG. 5) which is secured to the back side of 142*a* of the lockbox 140. The reflective strip 99 includes a plurality of signal means 100, 101, 102, 103, and 104 which are covered by an opaque strip 105. The retroreflective assembly 96 detects the presence or absence of the signal means 100–104 through the opaque cover 105 to locate a specific lockbox having the appropriate code. This is accomplished using a binary system whereby the retroreflective assembly 96 can detect the presence or absence of a signal means 100–104. Schematically shown at 106 is the absence of a reflective strip or signal means. The presence or absence of the signal means could be assigned a 1 or a 0 which would provide a binary signal to the processor control for the printer mechanism to determine the location of a specific lockbox and direct documents to that lockbox. It is understood that different arrangement of the signal means could be provided so that numerous lockboxes could be utilized and differentiated between when positioned in the output bin.

Figure 4:
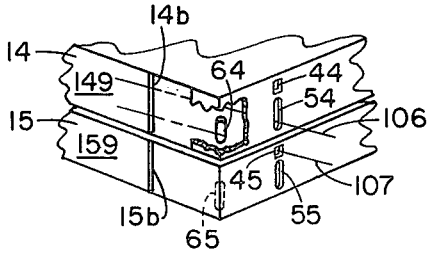
FIG. 4 is a partial schematic view showing the lines of movement of the signals from the LED through the apertures of the output bins for detection by the detector.

In operation, the scanning mechanism is caused to travel between the bins 14–23 by actuation of the motor 82. Upon movement of the carriage 75, the light beam shown schematically as 106 in FIG. 4 passes through slot 54 to detect the amount of documents already positioned in the output bit 14. In order to detect when there are no documents in the output bin 14 the light beam shown schematically as 107, passes through slot 64 and slot 45. This operation continues until the carriage 75 has scanned the bins 14–23 to detect the amount of paper or abasence of paper in the output bin. The photo detector 94 is connected to a tachometer which provides tachometer pulses which are indicative of the amount of paper in each lockbox. Paper in the bin or lockbox will prevent transmission of a light beam which will be detected by detector 94 to send the signal to the control mechanism to indicate the amount of paper in the box. When the beam passes through the slot 64 and 65 it indicates that the box is completely empty and does not contain a lockbox.

A light beam from the LED 91 to the photo sensor 94 is at an angle of approximately 17 degrees so that it can pass through the slot 64 and 45 and detect when there is not paper at all in an output bin.

The lockbox 140 includes a slot 145 and a slot 146 which allows passage of the light beam through the lockbox when it is fully positioned in an output bin to detect the amount of documents in a lockbox. As will be apparent, unless the lockbox is fully inserted into the output in the output bin, the light beam cannot pass through the slots 145 and 146. Rather the light beam will strike the opaque material of which the lockbox 140 is instructed and signal the control that the bin is full. In the case of the lockbox, the light beam cannot pass through the slot 64–73 or slots 44–53.

A microprocessor in the printer mechanism 10 or in the output module 12 and 13 determines the fullness of the output bin as a function of the number of tachometer counts traversed since the output bin bottom was detected. The retroreflective assembly 96 detects the coding presence or absence as signal means 100–104 or absence thereof which determines the specific location of a lockbox and whether or not a lockbox is available in a particular output bin.

Although the invention has been described in conjunction with the foregoing specific embodiment, many alternatives, variations and modifications are intended to fall within the spirit and scope of the appended claims.

I claim:

1. A word processor-controlled printer output bin apparatus having a scanning means comprising:

a word processing bin module having a plurality of output bins for receiving printed documents from a word processor;

a scanning means for scanning the plurality of output bins, said scanning means having a signal generating means and a signal detector means to detect a signal from the signal generating means to determine from interruptions in the signal as each output bin is scanned the presence or absence of documents in an output bin to provide an indication to a word processor-controlled printer of the availability of the output bin for receipt of documents and the amount of documents it is capable of receiving.

2. The apparatus as set forth in claim 1, wherein:

the scanning means includes a scanner operatively mounted with a track for movement of the scanner along the track to scan the plurality of output bins.

3. The apparatus as set forth in claim 1, wherein:

the scanning means includes a light source and the detecting means is a photo detector for detecting a light source from the light source.

4. The apparatus as set forth in claim 1, wherein:

each output bin has an open passage therethrough for passage of the signal from the signal generating means to the signal detecting means.

5. The apparatus as set forth in claim 1, further including:

at least one lockbox insertable in one of said output bins such that documents directed to such output bin are introduced into said lockbox;

said lockbox including a selectably engageable locking mechanism such that printed documents routed into said lockbox cannot be removed without disengaging said locking mechanism;

said scanning means including lockbox detection means and said lockbox including lockbox identification means such that said scanning means provides an indication of the presence of a lockbox when scanning an output bin containing such lockbox.

6. The apparatus as set forth in claim 5, wherein said lockbox further includes:

an entry slot and an exit slot disposed in said lockbox such that, when scanned by said scanning means, a signal path is provided from said signal generating means through said entry slot into the interior of said lockbox and out of said exit slot to said signal detector means;

said scanning means being responsive to interruptions in the signal received at said signal detector means while the output bin containing such lockbox is being scanned to provide an indication of the amount of documents in said lockbox.

7. A word processor-controlled printer output bin apparatus having a scanning means comprising:

a printer output bin module having a plurality of output bins for selectably receiving printed documents from a printer;

scanning means movable with respect to said output bins for scanning said output bins, said scanning means including a signal generator and a signal detector defining a scanning signal path forming an acute angle with respect to the bottom surface of an output bin;

each of said output bins being configured to provide (i) a bin scanning opening, and (ii) a bin-empty slot in the bottom of such output bin, such that as said scanning means traverses each output bin said scanning signal is scanned (i) through said corresponding bin scanning opening and at least a portion of the interior of such bin, and (ii) through said corresponding bin-empty slot; and position indication means for providing an indication of the position of said scanning means with respect to an output bin;

such that scanning an output bin provides indications of (i) interruptions in said scanning signal and (ii) the position of said scanning means, thereby indicating either (i) that the output bin is empty, or (ii) of the amount of documents contained in such output bin.

8. The apparatus as set forth in claim 7 wherein said scanning means includes a scanner mechanism operatively mounted with a track for movement of the scanner mechanism along the track in the direction of document stacking to scan the plurality of output bins.

9. The apparatus as set forth in claim 8 wherein said position indication means comprises;

a motor coupled to said scanner mechanism such that engaging said motor causes said scanner mechanism to move along said output bins; and tachometer means coupled to said motor for providing a tachometer count corresponding to the movement of said scanner mechanism, and therefore, the position of said scanner with respect to said output bins.

10. The apparatus as set forth in claim 9 wherein said signal generator is a light source and said signal detector is a photo detector.

* * * * *